United States Patent [19]

Heitman

[11] 4,307,975

[45] Dec. 29, 1981

[54] WATER FLOW CONTROL SYSTEM

[76] Inventor: Leroy M. Heitman, 28900 Ironwood, Sunnymead, Calif. 92388

[21] Appl. No.: 830,682

[22] Filed: Sep. 6, 1977

[51] Int. Cl.[3] ..... E02B 5/00; E02B 11/00

[52] U.S. Cl. ..... 405/36; 405/118

[58] Field of Search ..... 61/10, 11, 14, 35; 405/15, 36, 80, 118, 258

[56] References Cited

U.S. PATENT DOCUMENTS

| | | | |
|---|---|---|---|
| 302,322 | 7/1884 | Cole | 61/10 X |
| 1,866,826 | 7/1932 | Strothmann | 61/35 X |
| 2,138,366 | 11/1938 | Baird | 61/14 X |
| 2,170,671 | 8/1939 | Adler | 61/14 |

*Primary Examiner*—David H. Corbin

*Attorney, Agent, or Firm*—Harvey C. Nienow

[57] ABSTRACT

A water flow control system for surface water on a hillside wherein down drains and terrace drains are so shaped as to have a larger cross-section at those points where larger amounts of water are to be carried. Thus the down drain or drains are progressively larger at lower elevations and terrace drains are larger closer to the down drains to which they are connected. The terrace drains are so shaped and formed in the side of the slope as to eliminate the need for terrace pads, and thus are formed with opposite edges which are aligned with and in the plane of the slope itself.

8 Claims, 7 Drawing Figures

WATER FLOW CONTROL SYSTEM

The present invention relates generally to water flow control systems for surface water on hillsides and the like, but more particularly to such systems which permit of maximum utilization of the flat ground areas above and below the slope.

In certain scenic, geographical locations where the terrain is hilly and rolling, it is necessary to provide some sort of control means for the surface water as it drains down the various hillsides. Such surface water, of course, is the result of rains and snow thaws, and can produce unusually large quantities of water.

Not only is it desirable to conduct such water quickly and efficiently from one location to another, but it is desirable to prevent such flow of water from erroding the ground or earth on the hillsides where such water flows rapidly and in large quantities.

To attempt to accomplish this, it has become common practice to provide suitable concrete-lined ditches or down drains which conduct the water from the top to the bottom of the hillside. Connected into such down drains are terrace drains which run generally horizontally and conduct the surface water from other locations on the hillside to the down drains.

In view of the exceedingly high price of flat land today, it has become desirable to form or shape the hillside with a maximum slope to enable the relatively flat surfaces above and below the slope to be of maximum size or dimension. However, there is a limit to how steep such a slope can be, due to the greater likelihood of errosion with steeper slopes.

It is an object of the present invention to provide a water flow control system for use on hillsides and slopes to allow for maximum utilization of the ground above and below the slope while nonetheless properly conducting water down the slope.

Another object of the present invention is to provide a water flow control system as characterized above wherein the various down drains and terrace drains are cut into the slope without in any way disturbing the angle of the slope itself.

A still further object of the present invention is to provide a water flow control system as characterized above which is free of any pads or terraces whereon the various terrace drains have heretofore been cut.

An even further object of the present invention is to provide a water flow control system as characterized above wherein the down drains and terrace drains are varied in cross-sectional size, in accordance with the amount of water they will be required to carry.

A more specific object of the present invention is to provide a water flow control system as characterized above wherein the terrace drains are formed with a larger cross-section at or near the connection thereof to the down drain, but wherein the portions of such drains further removed from the down drain are formed with a smaller cross-section.

A still further object of the present invention is to provide a flow control system as characterized above wherein the down drains are formed with different cross-sectional dimensions, the lower elevational cross-sections being larger, to carry the greater quantity of water.

A still further object of the present invention is to provide a water flow control system as characterized above which is simple and inexpensive to build and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

Figure 4:
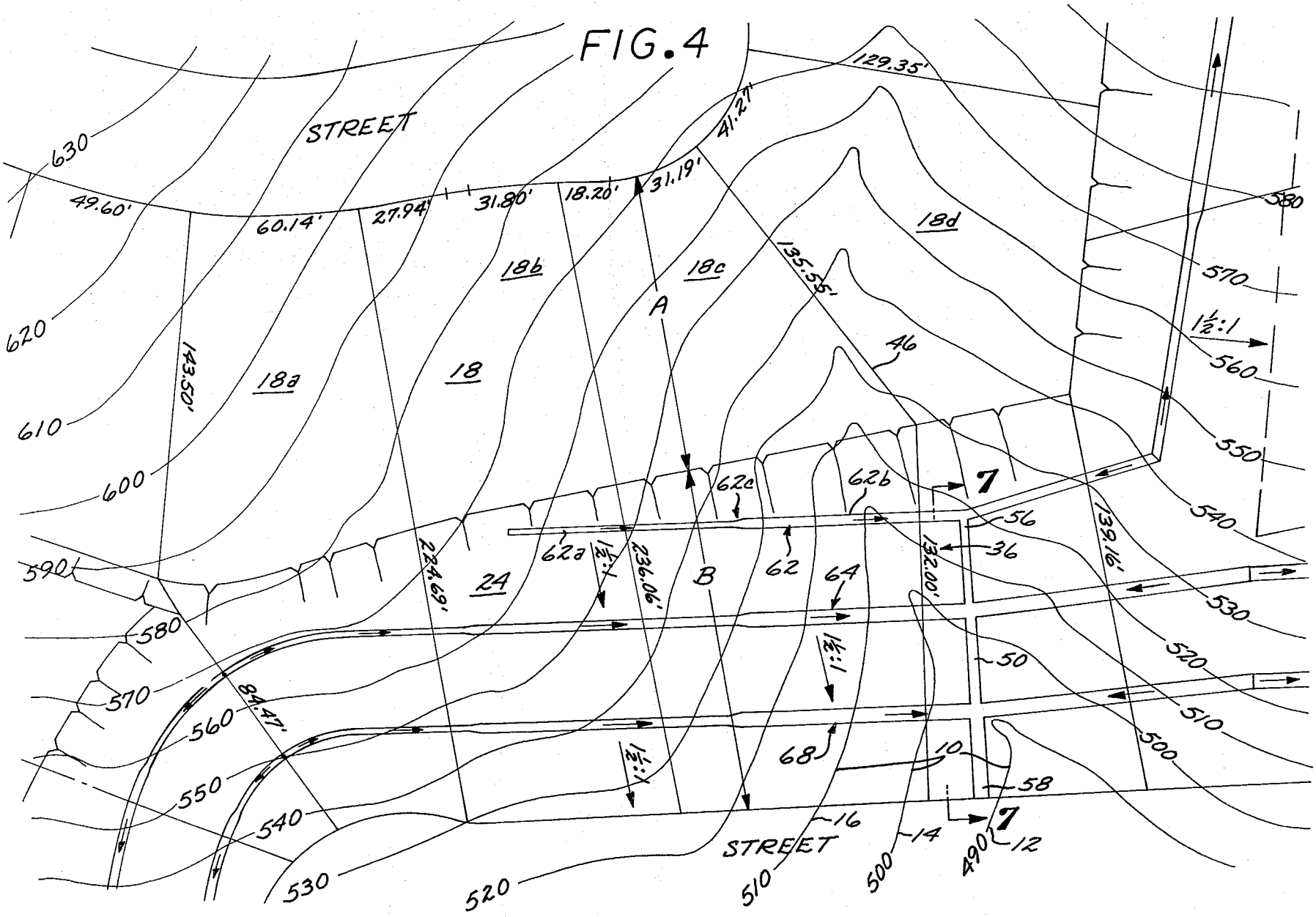
FIG. 4 is a plot plan of a typical slope and adjoining properties provided with a water flow control system according to the present invention.
Figure 5:
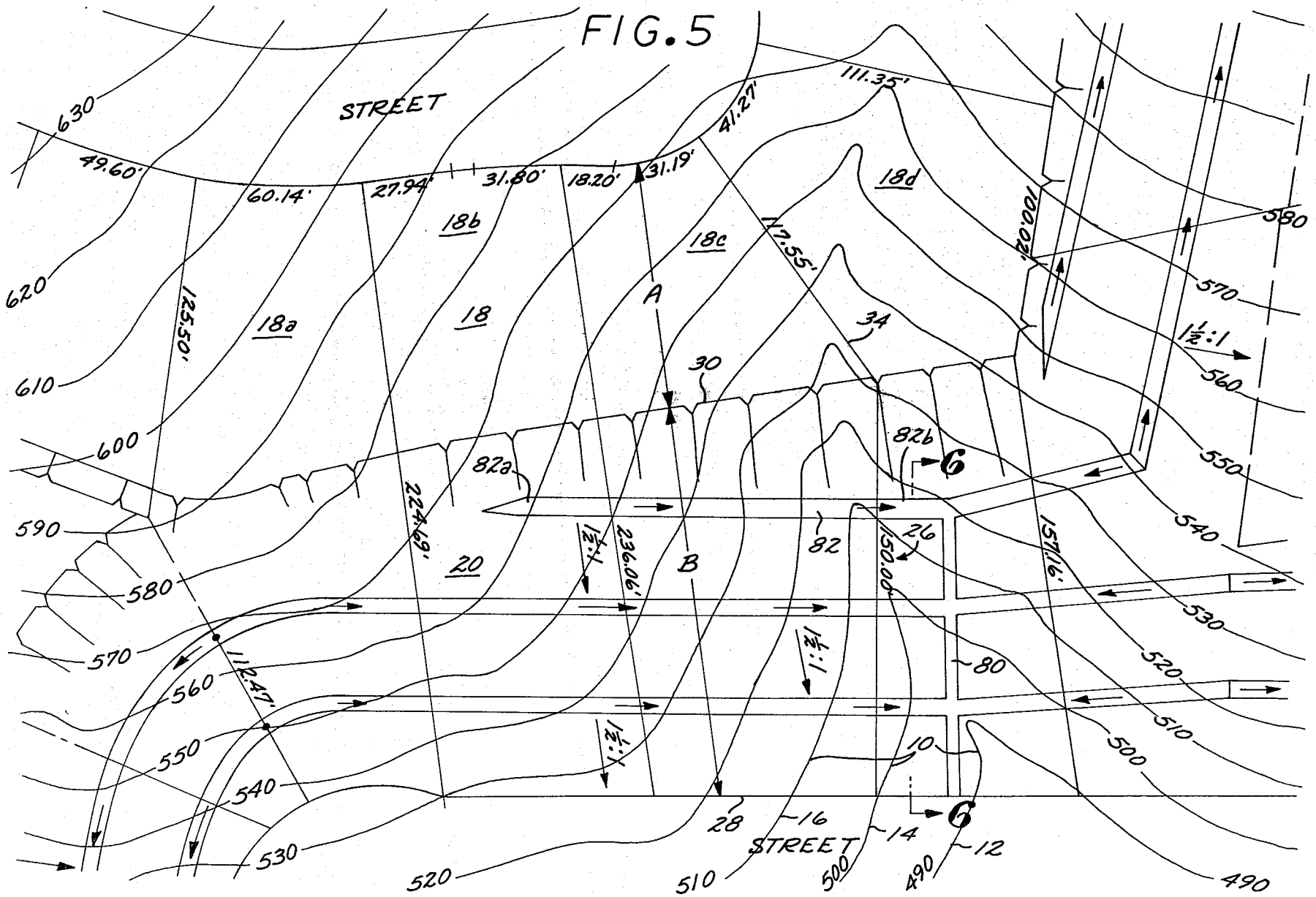
FIG. 5 is a similar plot plan showing a typical prior water control system.

Referring to FIGS. 4 and 5 of the drawings, there is shown therein a plot plan of land to be converted into maximum size lots for dwellings of one kind or another. These plot plans include elevation lines 10 which define common elevation points before grading of any kind. It will be noted that the plot plans of FIGS. 4 and 5 are substantially identical, the 490′ elevation contour line 12 on FIG. 4 being substantially identical with contour line 12 of FIG. 5. In like manner, the 500′ and 510′ elevation contour lines 14 and 16, respectively, on FIG. 4 are identical to those on FIG. 5.

Such irregular-shaped terrain is to be graded so as to provide maximum building sites in the upper area 18 above the hillside in each of the FIGS. 4 and 5.

Figure 6:
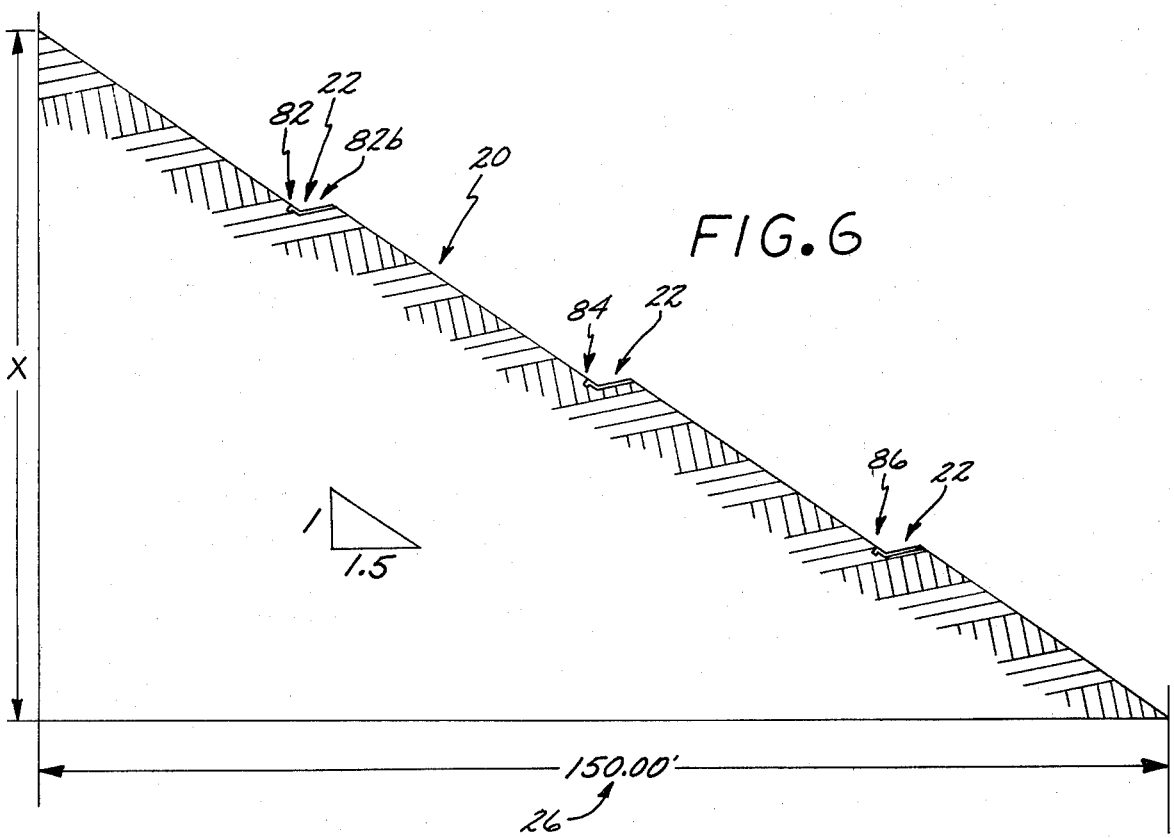
FIG. 6 is a contour sectional view of a slope, taken substantially along line 6—6 of FIG. 5.

Referring more particularly to FIGS. 5 and 6 of the drawings, there is shown therein typical grading of the hillside to a 1 to 1.5 slope. As shown in FIG. 6, such prior construction has been to provide generally horizontal pads or terraces 22 at spaced intervals down the slope, such pads generally being 6′ in width. With a given vertical dimension X shown to the left of FIG. 6, and by maintaining the 1 to 1.5 slope as shown at 20, the 6′ wide pads 22 cause the entire slope to consume a horizontal dimension of 150′ as shown at 26.

Referring to FIG. 5 and measuring 150′ horizontally from the base or curb line 28 at the street, a property line 30 is established with respect to the curb line 32. Such 150′ dimension causes the various home sites or lots 18*a*, 18*b*, 18*c* and 18*d* to have the dimensions as shown in FIG. 5. That is, referring to the property line 34 common to property sites 18*c* and 18*d*, it is seen that the 150′ horizontal dimension from street line 28 causes this property line to be 117.55′ from the curb 32 to the top of slope 20.

Figure 2:
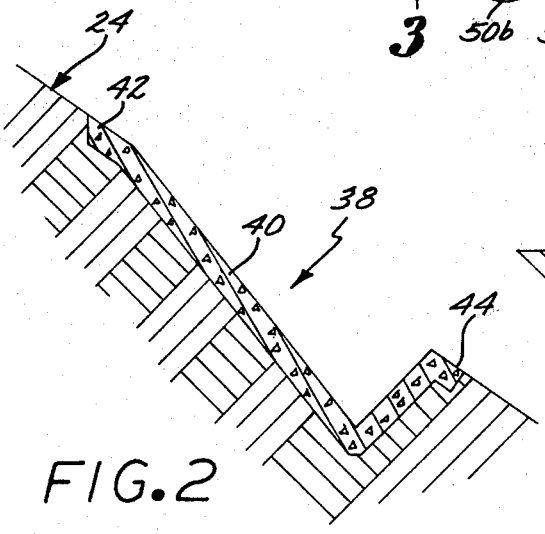
FIG. 2 is a sectional view taken through one of the terrace drains, substantially along line 2—2 of FIG. 1 of the drawings.
Figure 7:
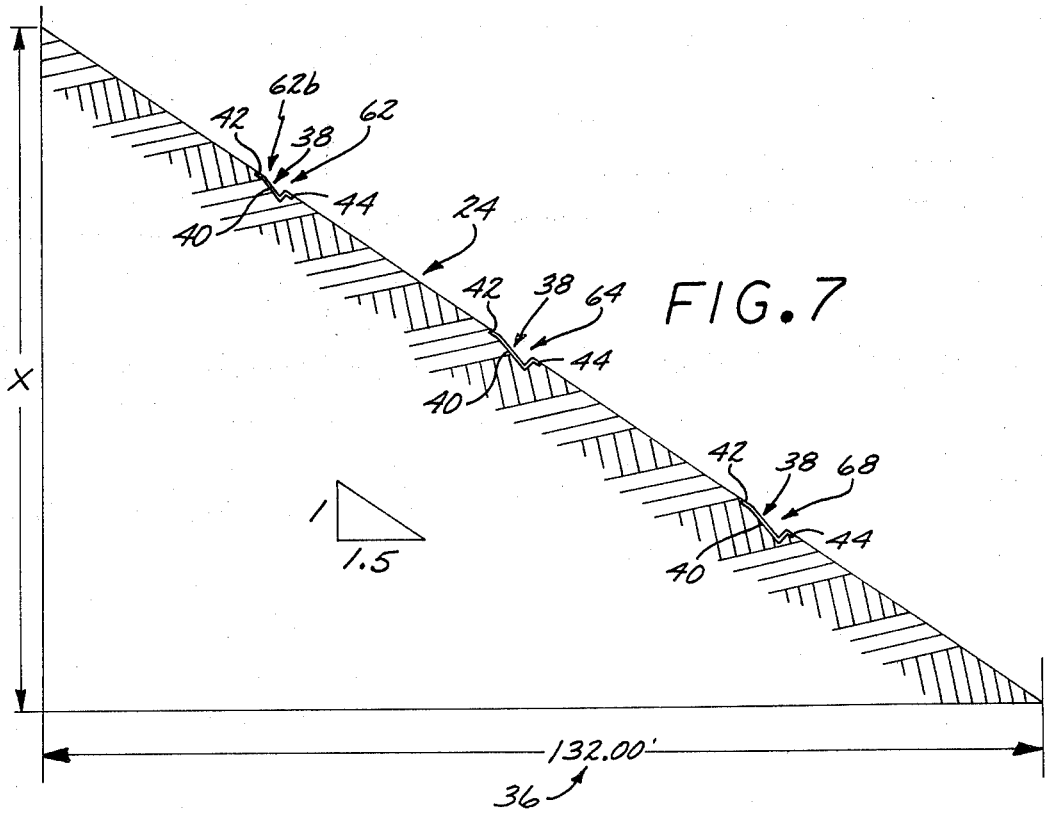
FIG. 7 is a similar contour sectional view taken substantially along line 7—7 of FIG. 4 of the drawings.

Now, referring to FIG. 7 of the drawings, by maintaining the same degree of slope, namely 1 to 1.5, and by maintaining the same vertical dimension X from the base to the top of the slope, it is seen that the horizontal dimension is smaller as shown at 36. This is due to the fact that the 1 to 1.5 slope 24 is maintained throughout its entire length, the terrace drains 38 being formed according to FIG. 2 of the drawings. Each such terrace drain is formed along the slope 24, the drain or ditch itself being lined with concrete as at 40 and is provided with keys 42 and 44 along its opposite edges. Such keys, it will be noted, are aligned with each other across the terrace drain 38 in alignment with the plane of slope 24. Thus the terrace drains 38 are formed without a pad or terrace step and conform to the 1 to 1.5 slope dimension.

Thus, the dimension at 36 is only 132.00′ whereas the dimension at 26 is 150.00′. Relating this to the plot plans shown in FIGS. 4 and 5, it is seen that the horizontal dimension 132.00′ shown at 36 causes the property sites 18*c* and 18*d* to have a common property line 46 of 135.55′. This, it will be noted, is 18′ longer than the common property line 34 shown in FIG. 5 which resulted from use of the prior flow control system. The net effect is to increase all of the building sites 18*a*, 18*b*, 18*c* and 18*d* while nonetheless maintaining the slope 24 at the desired safe dimensions. As will be readily realized by those persons skilled in the art, the water flow control system shown in FIG. 7 could be used to increase the flat or horizontal land dimensions below the slope.

Figure 1:
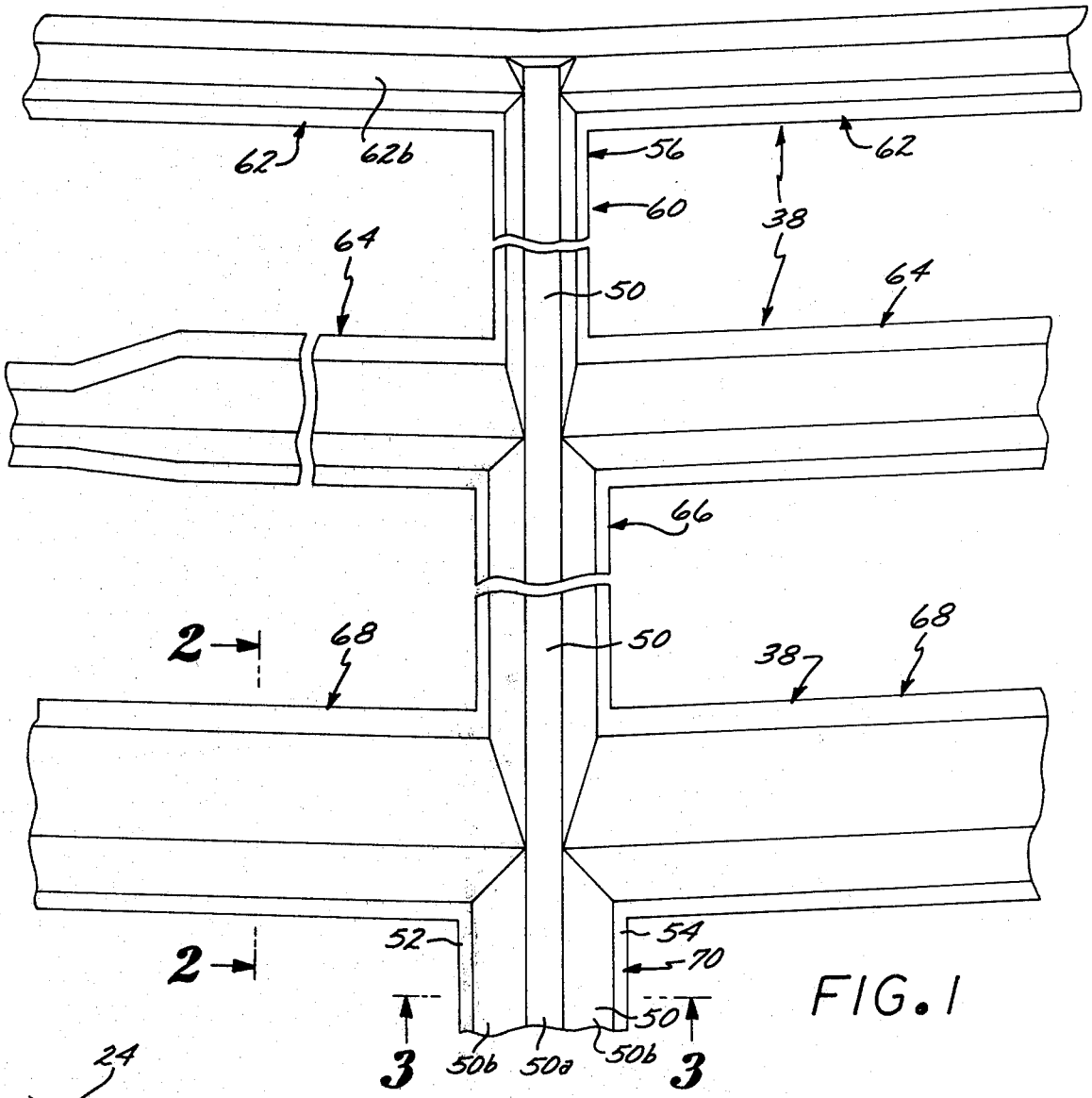
FIG. 1 is a fragmentary plan view of a portion of a water flow control system according to the present invention.
Figure 3:
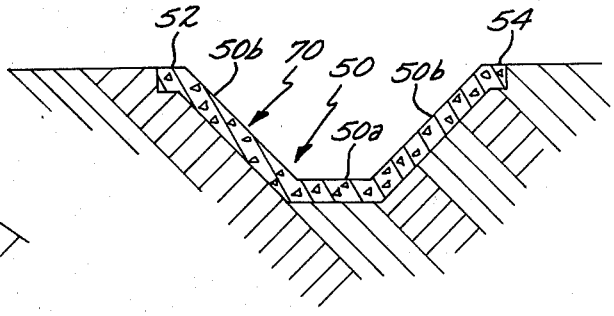
FIG. 3 is a sectional view of a down drain, taken substantially along line 3—3 of FIG. 1.

Referring to FIG. 3 of the drawings, there is shown therein the general cross-sectional dimensions for the down drain 50 of FIG. 1. Such down drain is formed with a generally flat bottom portion 50*a* and a pair of side portions 50*b*. It is concrete-lined, as shown, and is provided with keys 52 and 54.

To further increase the efficiency of the flow control system for slope 24, the down drain 50 as shown in FIG. 4, varies in size from smallest cross-sectional dimensions at the top, as shown at 56, to largest cross-sectional dimensions as shown at the lower elevations as at 58. Thus, as shown in FIG. 1 of the drawings, the down drain section 60 between terrace drains 62 and 64 is formed with a smaller cross-section than is down drain section 66 between terrace drains 64 and 68. In like fashion, the down drain section 70 below the terrace drain 68 is formed with an even wider or larger cross-section than down drain section 66.

As shown most particularly in FIG. 4 of the drawings, the terrace drains 62, 64 and 68 are likewise varied in cross-section depending upon the amount of water they are to carry. That is, referring to terrace drain 62, it is seen that the end portion 62*a* thereof is of smaller cross-section than the section 62*b* thereof. This is due to the change in size as shown at 62*c*. It is contemplated that the end 62*a* will carry a smaller amount of water and hence it is of smaller cross-section. Conversely, section 62*b* will carry a larger amount of water and thus is of larger cross-sectional area.

It is contemplated that instead of employing an abrupt change in cross-sectional area as shown at 62*c*, the entire terrace drain 62 could continuously vary from one end to the other, the points closer to the down drain 50 being of progressively larger cross-section. The other terrace drains 64 and 68 are also similarly formed with varying cross-sections to accomodate the corresponding amount of water.

This efficient flow control system is to be contrasted with that shown in FIG. 5 wherein the down drain 80 and the various terrace drains 82, 84 and 86 are of constant cross-section throughout their respective lengths. That is, such drains are built with the same cross-section throughout their lengths, in spite of the varying amounts of water which they are to carry.

Referring to terrace drain 82 of FIG. 5, it is seen that the end portion 82*a* thereof is of the same cross-section as is the portion 82*b*. However, the end portion 82*a* will have to carry a considerably smaller quantity of water than will the section at 82*b* due to the fact that the direction of flow is from 82*a* to 82*b*. In like fashion, the portions of down drain 80 at lower elevations will be required to carry more water than the portions at the high elevations. In spite of that, the old flow control system as shown in FIG. 5, has the down drain 80 shown of constant cross-section throughout its length.

It is thus seen that the present invention provides an efficient water flow control system which minimizes the amount of materials used and the amount of slope surface which is required, whereby the size of property sites is increased appreciably enabling more efficient use of the horizontal living area of the land.

Although I have shown and described certain specific embodiments of my invention, I am well aware that many modifications thereof are possible. The invention is not to be restricted except insofar as is necessitated by the prior art and by the spirit of the appended claims.

I claim:

1. Hillside water flow control system comprising in combination, a network of water conducting channels formed in a hillside of predetermined continuous slope free of pads, benches and the like and comprising at least one down drain and one or more terrace drains connected to said down drain, said terrace drain being cut into and along said slope such that its upper and lower edges are in the same plane as said slope.

2. Hillside water flow control system according to claim 1, wherein said terrace drain is formed with keys along said upper and lower edges aligned with each other in said slope plane.

3. Hillside water flow control system according to claim 2, wherein said terrace drain varies in cross-section along its length, being of larger cross-section closer to said down drain.

4. Hillside water flow control system according to claim 3, wherein said terrace drain varies in cross-section in proportion to the amount of water each cross-section is to conduct to said down drain.

5. Hillside water flow control system according to claim 1, wherein said down drain varies in cross-section along its length, being of larger cross-section at lower elevational points.

6. Hillside water flow control system according to claim 5, wherein said down drain varies in cross-section in proportion to the amount of water each cross-section is to conduct down said slope.

7. Hillside water flow control system according to claim 6, wherein said down drain and terrace drain are lined with concrete.

8. Hillside water flow control system according to claim 7, wherein said drains are each formed with substantially identical cross-section throughout a predetermined length and are then reduced in cross-section a predetermined amount for a given additional length thereof.

* * * * *